US011262162B1

(12) United States Patent
Warren

(10) Patent No.: US 11,262,162 B1
(45) Date of Patent: Mar. 1, 2022

(54) REAR SIGHT WITH INTERCHANGEABLE NOTCH INSERT

(71) Applicant: Scott M. Warren, Montclair, VA (US)

(72) Inventor: Scott M. Warren, Montclair, VA (US)

( * ) Notice: Subject to any disclaimer, the term of this patent is extended or adjusted under 35 U.S.C. 154(b) by 0 days.

(21) Appl. No.: 16/747,728

(22) Filed: Jan. 21, 2020

Related U.S. Application Data

(60) Provisional application No. 62/795,257, filed on Jan. 22, 2019.

(51) Int. Cl.
*F41G 1/10* (2006.01)
*F41G 11/00* (2006.01)
*F41G 1/16* (2006.01)

(52) U.S. Cl.
CPC ..... *F41G 1/10* (2013.01); *F41G 1/16* (2013.01); *F41G 11/001* (2013.01)

(58) Field of Classification Search
CPC ..... F41G 1/10; F41G 1/16
See application file for complete search history.

(56) References Cited

U.S. PATENT DOCUMENTS 4,388,772 A * 6/1983 Maes ..... F41G 1/16 42/135
4,606,131 A * 8/1986 Domian ..... F41G 1/16 42/137
7,526,890 B1 * 5/2009 Keng ..... F41G 1/18 42/111
7,743,546 B2 * 6/2010 Keng ..... F41G 11/003 42/145
8,997,391 B2 * 4/2015 Rozic ..... F41G 1/10 42/111
9,574,853 B2 * 2/2017 Crispin ..... F41G 11/007
9,714,811 B2 * 7/2017 Pulit, Jr. ..... F41G 1/10
10,767,960 B2 * 9/2020 Noonan ..... F41G 1/18
10,845,160 B1 * 11/2020 Warren ..... F41G 1/10

OTHER PUBLICATIONS

"File:Open sight types.svg", Wikimedia Commons, File:Open sight types.svg (Year: 2011).*

* cited by examiner

*Primary Examiner* — Joshua T Semick
(74) *Attorney, Agent, or Firm* — Foley & Lardner LLP

(57) ABSTRACT

A rear sight is provided for use on a firearm. The rear sight includes a changeable and removable rear sight notch insert. The rear sight further includes a rear sight blade having a cavity configured to receive the changeable, removable rear sight notch insert. The changeable, removable rear sight notch insert includes one or more tabs to facilitate insertion or removal of the rear sight notch insert into or out of the cavity. The rear sight notch inserts are variable in notch width, notch depth, and notch shape.

30 Claims, 16 Drawing Sheets

REAR SIGHT WITH INTERCHANGEABLE NOTCH INSERT

CROSS-REFERENCE TO RELATED APPLICATIONS

This application claims the benefit of and priority to U.S. Provisional Application No. 62/795,257, filed Jan. 22, 2019, which is incorporated herein by reference in its entirety.

BACKGROUND

The present application relates to the field of sights for firearms. More specifically, the present application relates to a rear sight for a firearm designed to accept and securely hold a notch insert with a variety of designs allowing for an extensive range of notch dimensions, designs, and shapes.

A simple sighting mechanism for a firearm typically includes a front sight near the muzzle and a rear sight near the hammer or striker, which is positioned closer to the shooter (the user of the firearm). When shooting, the front sight and the rear sight are aligned such that the positive shape of the body of the front sight is positioned to be within the negative space of a notch in the rear sight, so as to fall within the design and/or shape of the notch in the rear sight. When the front sight is centered relative to the rear sight, there is an equal amount of light, referred to as "light bars" on either side or around of the front sight as viewed through the notch design in the rear sight. The width of the rear sight notch, the design of the notch, and/or shape of the notch can affect the amount of light seen by the user.

Either with law enforcement training, competitive action shooting or self-defense training, when learning to shoot, an individual must learn to shoot accurately and then quickly. A narrow notch greatly aids or assists with learning to shoot accurately. Then once the individual can shoot accurately, they learn to shoot more quickly. A wide notch greatly aids or assists with this. Due to differences in personal preferences, shooting styles and techniques, for different users, the same rear sight design may be manufactured with a variety of rear sight aperture dimensions and/or designs.

Conventionally, since the rear notch is machined/cut into the metal sight, it cannot be quickly modified or changed. It can be machined to a larger size, but not to a smaller size. Modifying or changing a notch size involves securing it in a vice or a milling machine and then cutting metal away to increase the size of the opening. The sight then has to be refinished, blued and then reinstalled. To reduce the size of the rear notch would be even more time consuming and would involve removing the sight, filling the notch with a metal insert, welding the metal insert in place, machining the metal insert to match the sight's surface and then machining a smaller notch size Another disadvantage of removing and reinstalling sights is the accumulative wearing of the fitted parts. Each time this is done, it alters the mating surfaces of the parts. This wearing out of fitted parts is not desirable. A sight that does not fit securely will move or "walk" each time the handgun is shot. This will result in inaccurate shot placement.

The problem of only having one size rear sight notch is an issue for both fixed and adjustable rear sights. The width and/or depth of the rear sight notch cannot easily be changed when training, cannot easily be changed when practicing engaging small targets or when engaging distance targets, cannot be changed when going from day light to night time for carry.

SUMMARY

One disclosed embodiment relates to a rear sight for use on a firearm. The rear sight includes a rear sight blade connected to a mounting base. The mounting base is configured to be connected to a top surface of the firearm. The rear blade includes a sighting notch cavity that is a positioning cut that accurately locates interchangeable sighting notch inserts to be aligned with a front sight or any portion or part of a front sight. In at least one embodiment, the cavity is arranged so as to locate the sighting notch inserts with respect to a post of a front sight.

The interchangeable sighting notch element design allows for an extensive range of notch dimensions, designs, and shapes. If a user (e.g., a shooter) is engaging close targets, e.g., targets within 10 to 15 yards away or targets with a large scoring area, for example, the user can use a sighting notch insert with a wide notch. On the other hand, if the user is engaging mid-distant targets, e.g., targets that more than 15 to 20 yards away, the user can use a sighting notch insert with a medium size notch. If the user is engaging far distant targets, e.g., targets within 20 to 30 yards away, or targets with a very small scoring area, the user can use a sighting notch insert with a narrow size notch. If the user is engaging small steel circular plates as targets, the user can use a circular notch, for example.

At least one disclosed embodiment relates to a rear sight that is provided for use on a firearm. The rear sight includes a changeable and removable rear sight notch insert. The rear sight further includes a rear sight blade having a cavity configured to receive the changeable, removable rear sight notch insert. The changeable, removable rear sight notch insert includes one or more tabs to facilitate insertion or removal of the rear sight notch insert into or out of the cavity.

Another disclosed embodiment relates to a rear sight for use on a firearm. The rear sight includes a changeable, removable rear sight blade configured to couple to a mounting base. The changeable, removable rear sight blade is configured to allow a rear sighting notch to be aligned with a post on a front sight. A configuration of the rear sighting notch is variable.

Yet another disclosed embodiment relates to a method of utilizing a rear sight on a top surface of a firearm. The method includes inserting a changeable, removable rear sight notch insert into a cavity, which is configured to accept the same, and which cavity is present in a rear sight blade that is installed on a mounting chassis.

It is to be understood that both the foregoing general description and the following detailed description are exemplary and explanatory only, and are not restrictive of the invention as claimed.

BRIEF DESCRIPTION OF THE DRAWINGS

Features, aspects, and advantages of the present invention will become apparent from the following description, appended claims, and the accompanying exemplary embodiments shown in the drawings, which are briefly described below.

DETAILED DESCRIPTION

Figure 1:
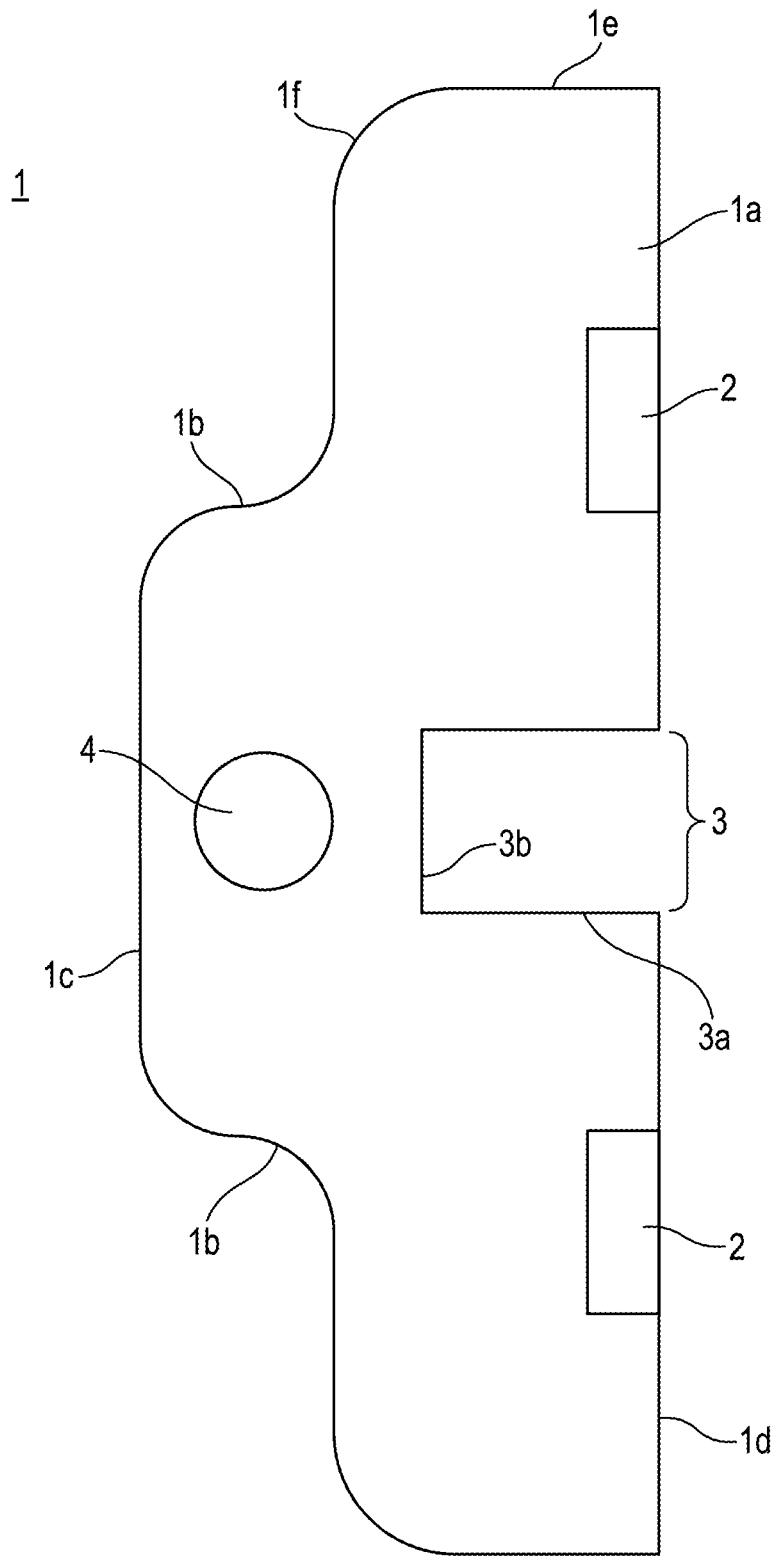
FIG. 1 is a rear view of a rear sight notch insert, according to a first exemplary embodiment.

Before turning to the figures, which illustrate the exemplary embodiments in detail, it should be understood that the present application is not limited to the details or methodology set forth in the description or illustrated in the figures. It should also be understood that the terminology is for the purpose of description only and should not be regarded as limiting. The illustrative embodiments described in the detailed description, drawings, and claims are not meant to be limiting. Other embodiments may be utilized, and other changes may be made, without departing from the spirit or scope of the subject matter presented here. It will be readily understood that the aspects of the present disclosure, as generally described herein, and illustrated in the figures, can be arranged, substituted, combined, and designed in a wide variety of different configurations, all of which are explicitly contemplated and made part of this disclosure.

The rear sight of certain exemplary embodiments described below includes a mechanism for quickly, easily, and efficiently installing and removing a rear sight notch insert. The rear sight notch insert may include a traditional sighting notch or a non-traditional sighting design to be aligned with the front sight. The rear sight notch insert is designed to quickly and efficiently allow a user to remove a rear sight notch insert and replace it with another rear sight notch insert that differs from the previously inserted rear sight notch insert. For example, the rear sight notch inserts may differ from each other in one or more of the following aspects. The rear sight notch inserts may have different notch dimensions, i.e. width and depth, or a different shape.

In some embodiments, the rear sight notch insert may have a traditional notch shape, such as a rectangular notch shape. Instead of a rectangular shape, an alternative shape such as a U-shaped notch (a "U-notch") or a circular "peep" notch may be used. In this manner, such embodiments allow for quick and efficient switching between different rear sight notch configurations, in mere seconds. The notch inserts that may be utilized are not limited to the aforementioned configurations. Rather, such embodiments allow for a multitude of notch designs to be employed, which may be selected depending on the user's preferences, experience, needs, situations, lighting conditions, target size, target shape, and target distances from the user, among other considerations.

Furthermore, the user can, with no or limited tools, remove an installed rear sight notch insert and replace it with another rear sight notch insert that differs in dimensions or shape, as described above. That is, both removal of a previously inserted rear sight notch insert and replacement with a subsequent insert may be accomplished quickly and easily, with minimal or no tools needed (e.g., a screwdriver). In particular, for the new or experienced shooter, for law enforcement personnel, for competitive shooting sports and/or when training for personal/home defense situations, such embodiments allows the user to select from among a wide array of notch insert options, and replace a rear sight notch insert with the rear sight notch insert that best provides the desired sight picture for the targets/threats that are evident or anticipated (day or night). Depending on the training, targets available and/or shooting situation, a notch can be selected that the individual best feels will help them to successfully engage the targets/threats.

Additionally, in such embodiments, the rear sight blade has its own negative space or notch, such that even when no rear sight notch insert is present, the user may opt to use the existing notch of the rear blade along as the notch of the rear sight. This provides the user with yet a further option for the rear sight notch configuration.

FIG. 1 is a rear view of a rear sight notch insert, according to a first exemplary embodiment. An insert 1 having a body 1*a* is depicted. The insert 1 has two tabs 2 respectively disposed on left and right sides of a notch 3, which is a rectangular notch. The notch 3 is centered so as to be at an approximate midpoint of the body 1*a* of insert 100 in the lengthwise direction of the body 1, so as to form a negative space that is cut out into side 1*d* of the insert 1. The notch 3 has a height 3*a* and a width 3*b*. As shown in FIG. 1, the insert 1 is formed such that the width 3*b* is less than the height 3*a*. In some embodiments, the width 3*b* and height 3*a* may be approximately equivalent. That is, a square notch 3 may be provided in some embodiments.

The insert 1 is further provided with an opening or hole 4. The opening 4 is positioned to align with a ball of a mounting chassis of a rear sight (discussed in more detail below). In some embodiments, opening 4 is positioned so as to be centered with respect to the notch 3, i.e., the midpoint of the notch 3 aligns with the midpoint of the opening 4 and the midpoint of the body 1*a* of insert 1. The opening 4 may be formed as a hemispherical member having a cupped shape in some embodiments. The opening 4 does not penetrate through the entirety of the body 1*a* of the insert 1, but rather may be formed as a recess in the body 1*a* that is formed like a "cup" so as to receive another element (e.g., a spring ball plunger, as discussed in more detail below). In some embodiments, the opening 4 may be circular or elliptical.

The opening 4 is positioned closer to a side 1*c* of the body 1 where "shoulders" 1*b* are formed on left and right sides and offset from the notch 4. The tabs 2, mentioned above, are formed at a side 1*d* that is opposite to side 1*c*. The edges 1*e* of the insert 1 may, in some embodiments, be formed with rounded shoulders if at the side closest to the shoulders 1*b*.

Figure 14:
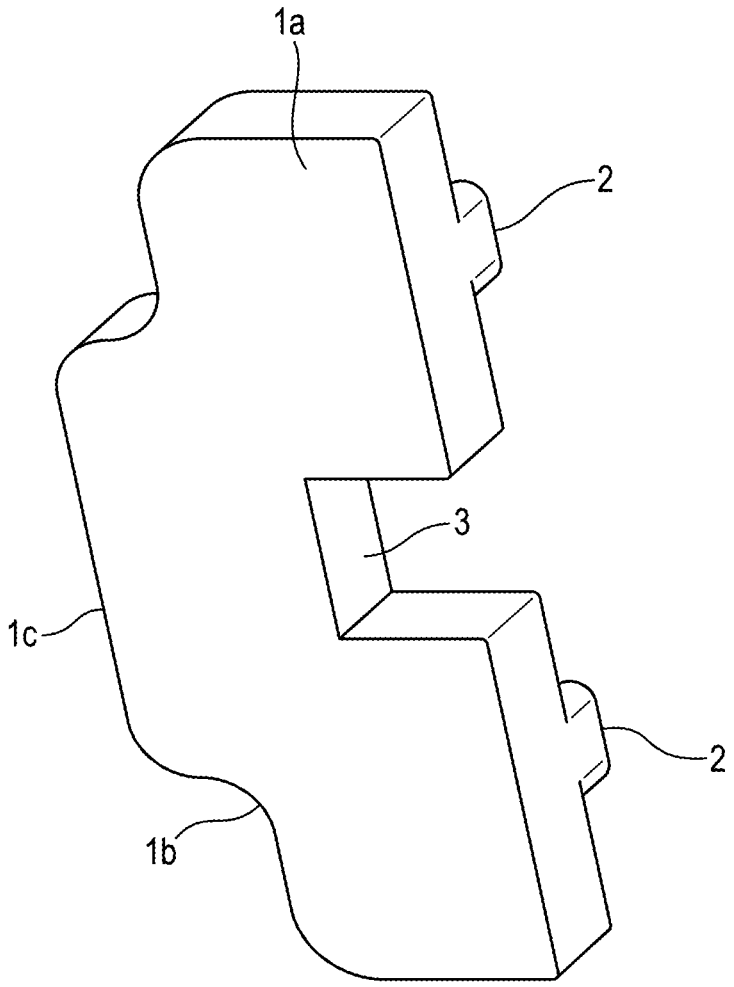
FIG. 14 is a front view of the rear sight notch insert shown in FIG. 1.
Figure 15:
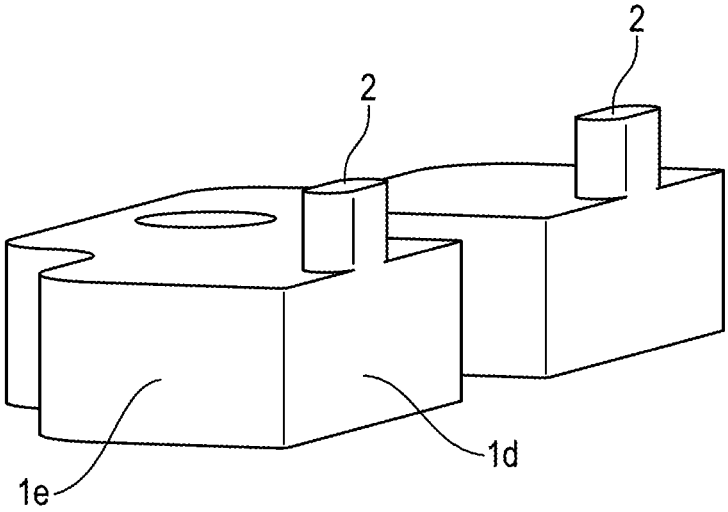
FIG. 15 is a side view of the rear sight notch insert shown in FIG. 1.
Figure 16:
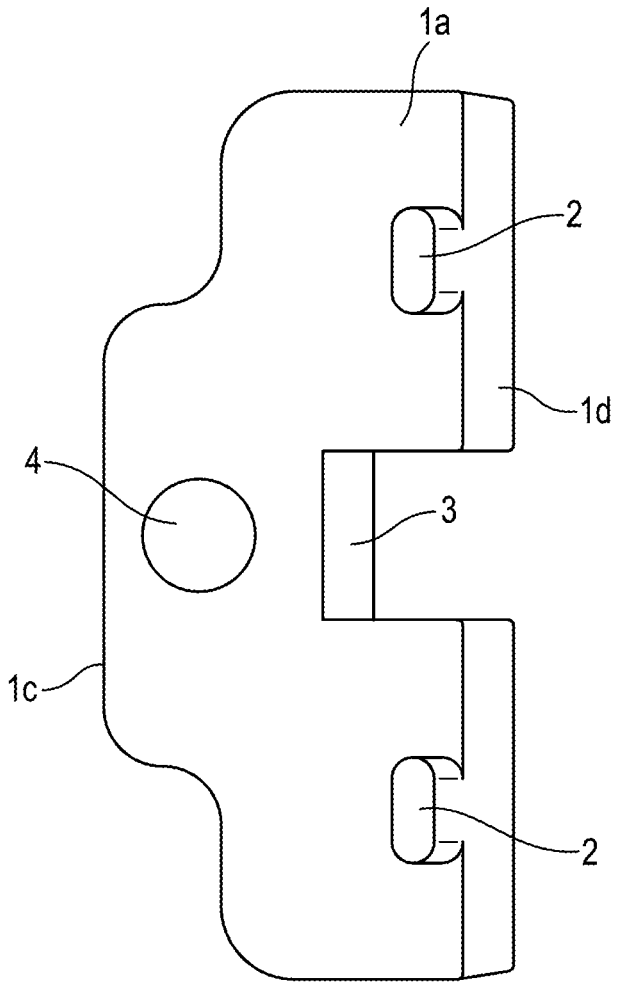
FIG. 16 is a rear view of the rear sight notch insert shown in FIG. 1.

FIG. 14, FIG. 15, and FIG. 16 respectively depict front, side and rear views of the rear sight notch insert 1 shown in FIG. 1.

The rear sight notch insert 1 is configured to be utilized with a rear sight blade as described in more detail below. The rear sight blade may be mounted on a firearm such as a handgun, a shotgun, or a rifle, according to some embodiments. In some embodiments, the rear sight blade may be configured for installation on a semiautomatic pistol. The rear sight blade may be attached to the semiautomatic pistol in accordance with the techniques set forth in U.S. Pat. No. 10,012,471 to Warren, which is incorporated herein by reference in its entirety for the rear sights and mounting techniques set forth therein.

In particular, the semiautomatic pistol includes a barrel, a chamber configured to receive a round and in communication with the barrel, and a trigger. The firearm further includes a slide which ejects a spent round from the chamber after the firearm is fired, readies the firing mechanism for another shot, and loads another round into the chamber. One or more sighting mechanisms may be present to aid the user in aiming the firearm. The sighting mechanisms may include a rear sight and a front sight disposed on an upper surface of the slide. The front sight is generally disposed towards the front of the of the slide (e.g., proximate the muzzle of the firearm, whereas the rear sight is generally disposed towards the rear of the slide, closer to the user than the front sight.

Figure 2:
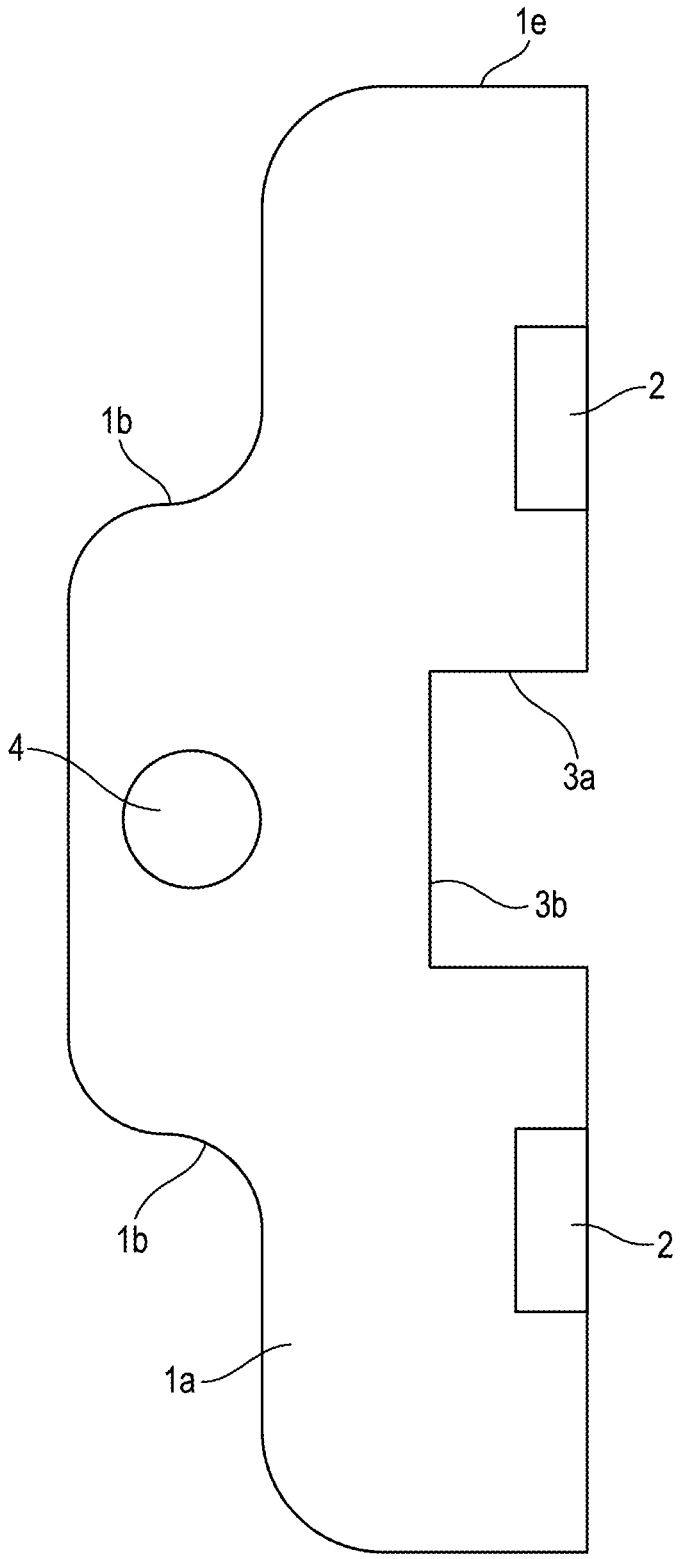
FIG. 2 is a rear view of a rear sight notch insert, according to a second exemplary embodiment.

FIG. 2 is a rear view of a rear sight notch insert, according to a second exemplary embodiment. In contrast to FIG. 1, the notch 3 of the insert 1 is formed such that the width 3*a* is less than the height 3*b*. However, in some embodiments, the width 3*b* and height 3*a* may be approximately equivalent. As noted above, the notch dimensions may be selected depending on the user's preferences, experience, needs, situations, lighting conditions, target size, target shape, and target distances from the user, for example. The insert 1 and notch 3 collectively make up a notched member that is configured to be visible to the user when inserted into a rear blade attached to a mounting chassis on a top surface of a firearm slide.

Figure 3:
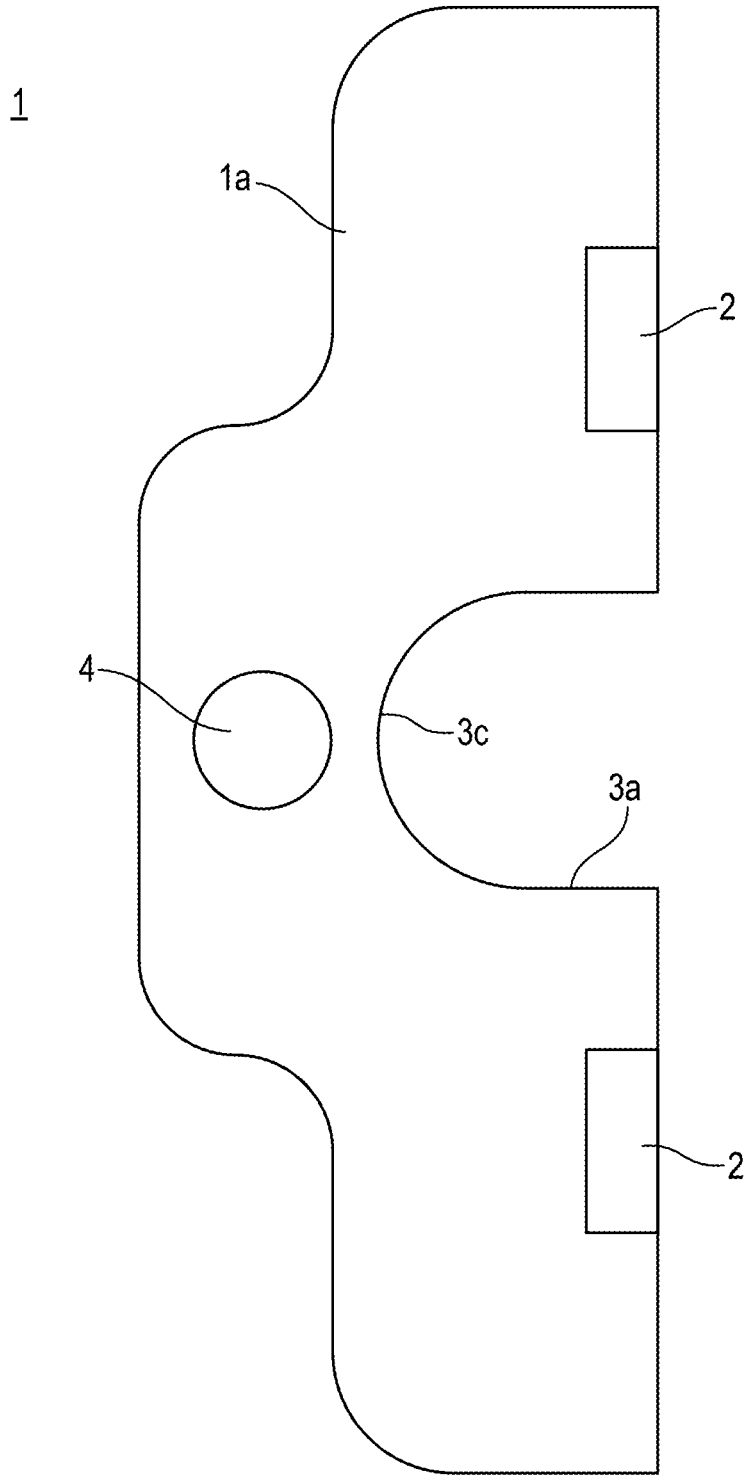
FIG. 3 is a rear view of a rear sight notch insert, according to a third exemplary embodiment.

FIG. 3 is a rear view of a rear sight notch insert, according to a third exemplary embodiment. The insert 1 shown in FIG. 3 differs from the inserts shown in FIGS. 1 and 2 in that the shape and dimensions of the notch 3 are different. In particular, FIG. 3 depicts a notch 3 that is arched (arcuate) in shape and which may be referred to as a "U" notch or U-shaped notch. The notch 3 has sides having a height 3*a* and an arch having a radius of curvature 3*c*. As the radius of curvature 3*c* is such that the arcuate notch 3 is cut further into the body 1*a* of insert 1 than the rectangular notch of the insert shown in FIG. 1, for example, it follows that the distance between the notch 3 and the opening 4 is correspondingly reduced. While the opening 4 is shown as being circular in such embodiments, it should be understood that the opening 4 may be polygonal or have an alternative shape and is not limited to the depicted circular shape.

Figure 4:
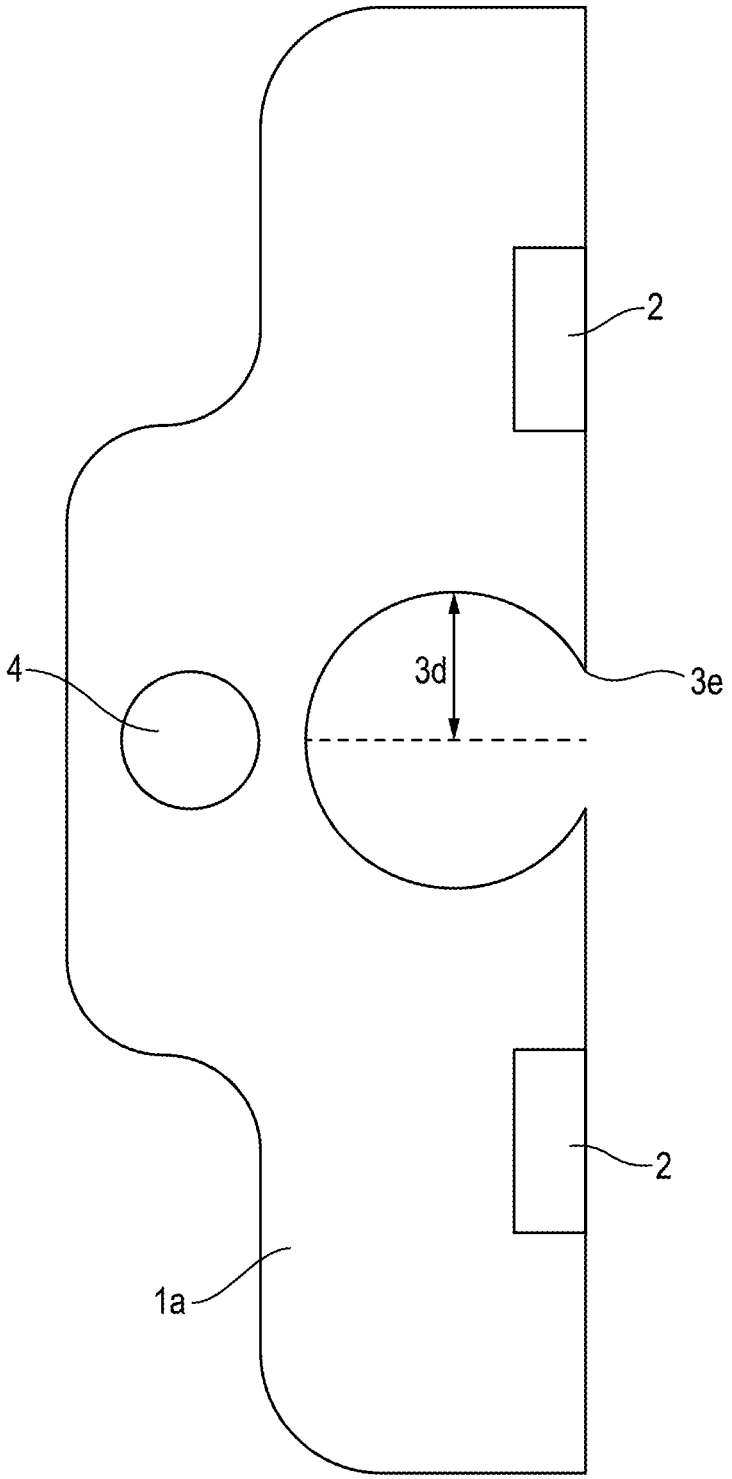
FIG. 4 is a rear view of a rear sight notch insert, according to a fourth exemplary embodiment.

FIG. 4 is a rear view of a rear sight notch insert, according to a fourth exemplary embodiment. The insert 1 shown in FIG. 4 has a notch 3 having a generally circular configuration. The notch 3 has a radius 3*d*. The circular notch 3 may be cut into the side of the body 1*a* of insert 1 not as a "perfect" circle, but with edges 3*e* formed at the interface between the notch 3 and the side 1*d* of the insert 1. The notch 3 having the generally circular configuration may be selected, for example, where the user desires to aim at circular targets such as relatively small circular metal targets.

Figure 5:
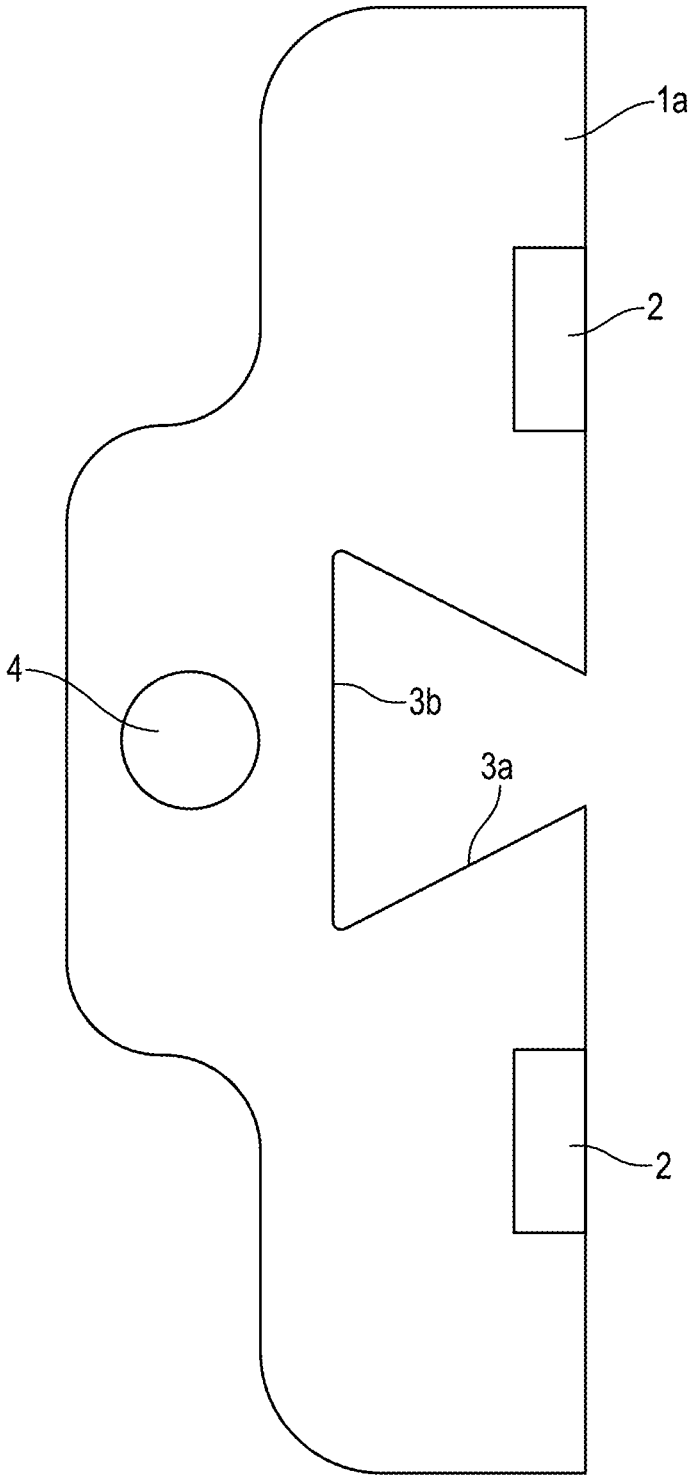
FIG. 5 is a rear view of a rear sight notch insert, according to a fifth exemplary embodiment.

FIG. 5 is a rear view of a rear sight notch insert, according to a fifth exemplary embodiment. The insert 1 shown in FIG. 4 includes a notch 3 having a generally triangular configuration. The generally triangular notch 3 has two angled sides having a height 3*a* and a width 3*b*. The notch 3 shown in FIG. 5 is generally shaped as an isosceles triangle. However, in some embodiments, other triangular forms may be selected, e.g., equilateral triangular shapes.

Figure 6:
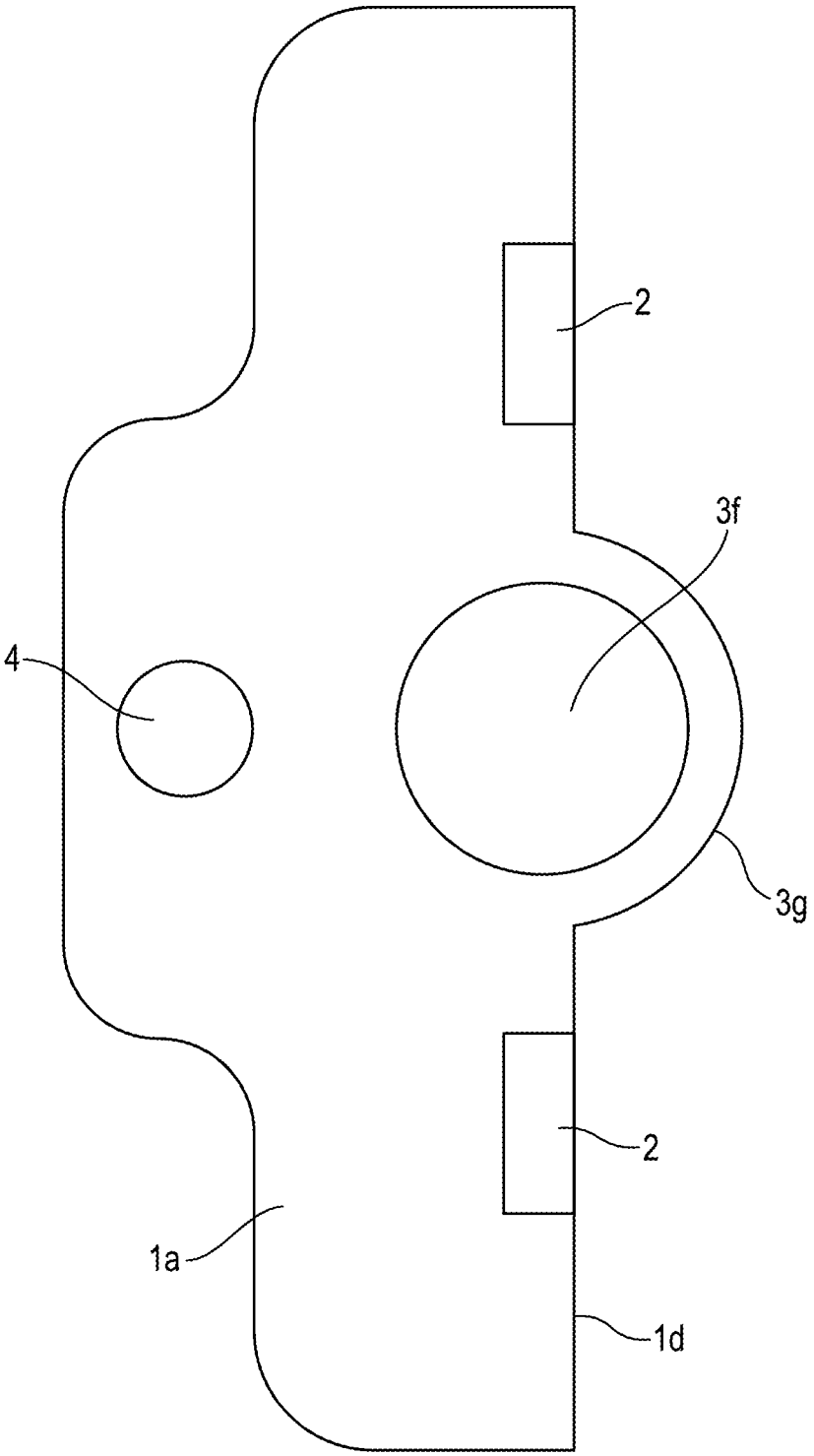
FIG. 6 is a rear view of a rear sight notch insert, according to a sixth exemplary embodiment.

FIG. 6 is a rear view of a rear sight notch insert, according to a sixth exemplary embodiment. The insert 1 shown in FIG. 6 has an enclosed circular notch 3 known as a "peep" notch. In contrast to the notch 3 shown in FIG. 4, the notch 3 shown in FIG. 6 is entirely enclosed within the body 1*a* of insert 1. That is, the negative space 3*f* of the notch is contained within the body 1*a* and is not directly formed by cutting into side 1*d* of the body 1*a*. More particularly, in contrast to FIG. 4, the notch 3 has an outer periphery 3*g* that projects past the side 1*d* of the insert 1.

Figure 7:
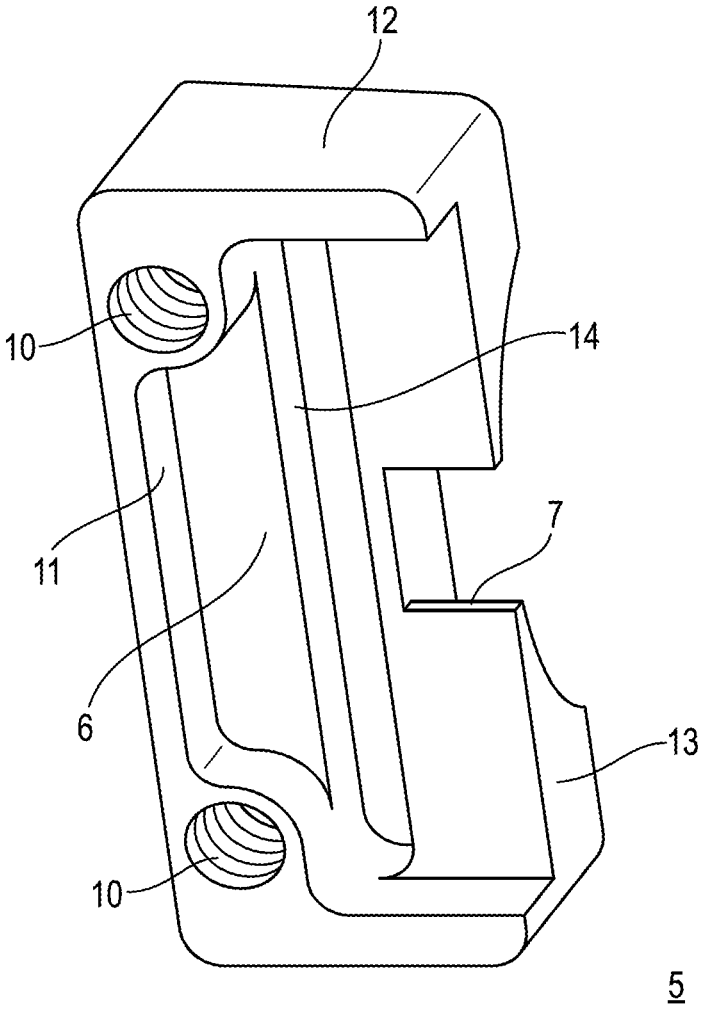
FIG. 7 is a rear view of a rear sight blade according to an exemplary embodiment.

FIG. 7 depicts a rear sight blade or housing 5 according to an exemplary embodiment. Rear sight blade 5 is defined by sidewalls 12 extending upward from a base 11. The sidewalls 12 and base 11 define a cavity 6 (a cut or a compartment) formed when the blade 5 is installed on a mounting chassis (discussed later). The cavity 6 is a cut that is formed by machining the blade 5. The cavity 6 is configured to accommodate therein the insert 1. More particularly, the cavity 6 is dimensioned so as to receive the body 1*a* therein, such that side 1*d* may be flush against the base 11. Apertures 10 are formed at left and right opposed sides of the base 11 between the base 11 and sidewalls 12. Apertures 10 are structured to receive fasteners (e.g., screws) to attach the blade 5 to the mounting chassis.

A ledge 14 is positioned above base 11 and beneath a notch 7, between the sidewalls 12. The sidewalls 12 extend up to an upper surface 13 of the rear blade 5. Cut into the upper surface 13 and the body of the blade 5 is a notch 7. Notch 7 is a negative space formed in the blade 5. When the insert 11 is not positioned in the cavity 6, the notch 7 can itself serve as the notch of the rear sight blade 5 in which the front sight may be aligned. The front sight includes an upwardly extending body (e.g., post, pin, ball, bar, etc., not shown) while the rear sight defines an aperture (e.g., space, notch, hole, gap, etc.), such as the notch 7 of the rear blade 5 or the notch 3 of the insert 1. When shooting, the sights of the front and rear sights are aligned such that the positive shape of the body of the front sight is positioned within the negative space of the aperture. Accordingly, even without the insert 1 present, the notch 7 is nevertheless present and serves as a rear sight notch.

Figure 8:
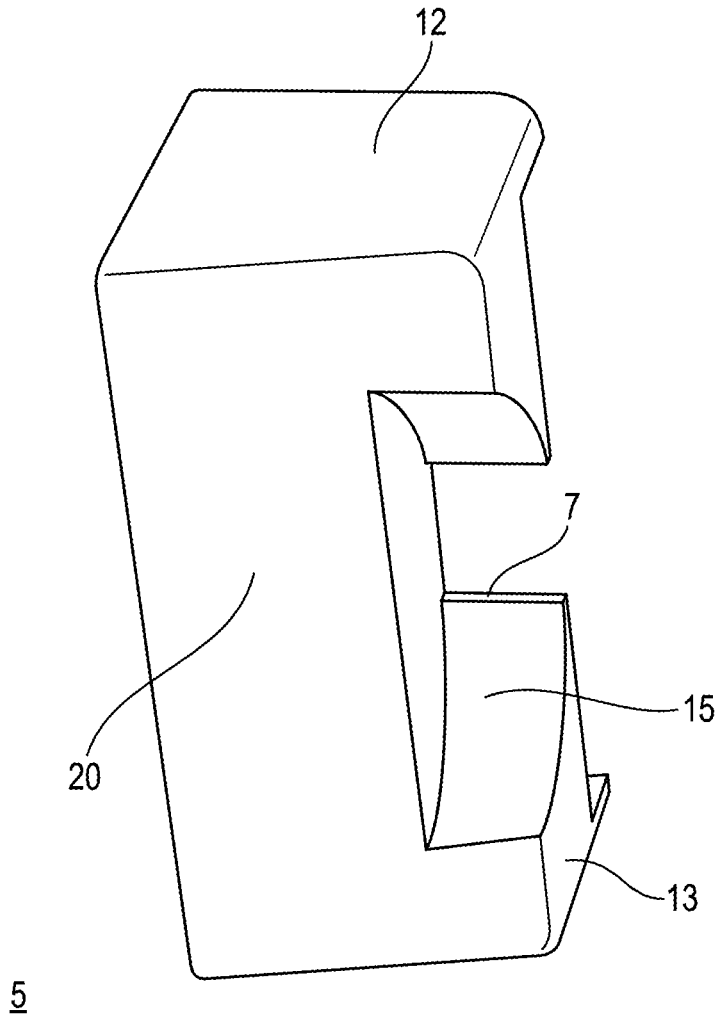
FIG. 8 is a front view of the rear sight blade shown in FIG. 7.

FIG. 8 is a front view of the rear sight blade 5 shown in FIG. 7. As shown in FIG. 8, the notch 7 is formed as part of an opening 15 in rear blade 5. The particular configuration of the rear blade is such that curved side faces of the window 15 provide a gentle or smooth visual transition from a rear surface of the rear sight blade 5 to the notch 7, as described in more detail in U.S. Pat. No. 10,012,471 to Warren, which is discussed above. The rear side blade 5 has a sloped front face 20 that is a face closest to the user (the shooter).

Figure 9:
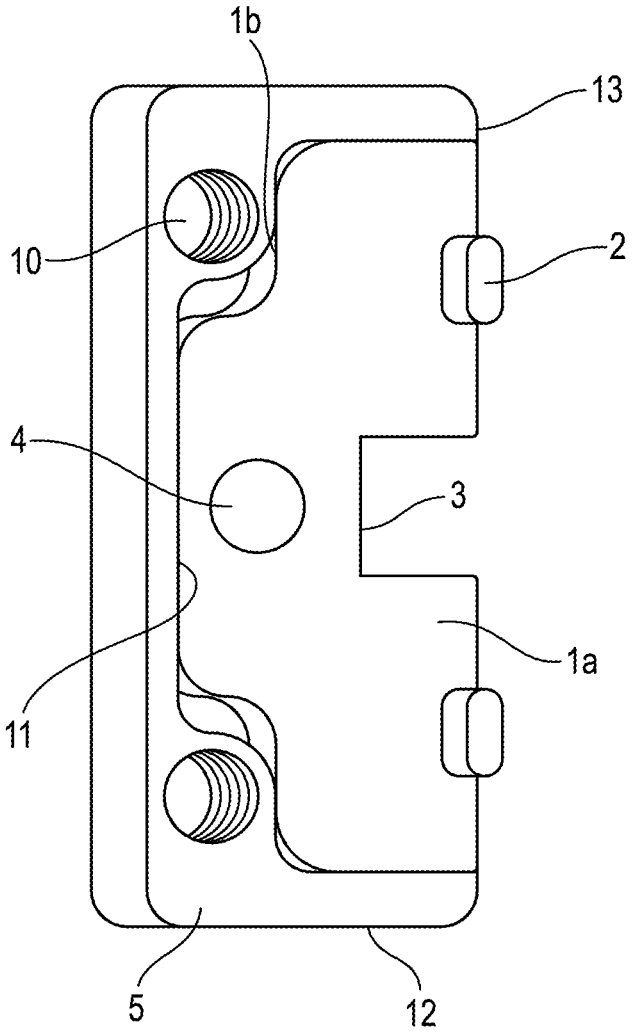
FIG. 9 is a rear view of the rear sight blade of FIG. 7 as assembled with a rear sight notch insert according to an exemplary embodiment.

FIG. 9 is a rear view of the rear sight blade 5 of FIG. 7 as assembled with a rear sight notch insert 1 according to an exemplary embodiment. A cavity 6 is defined by a negative space in the rear blade 5 when the rear blade 5 is attached to a mounting chassis, such as mounting chassis 18 shown in FIG. 10 and described below. FIG. 11 is a perspective view of a rear sight blade 5 attached to the mounting chassis 18, without the insert 11 present. As seen in FIG. 11, the cavity 6 is formed where the blade 5 is attached to mating surfaces of the mounting chassis 18, so as to create a compartment or recess bounded on one lateral side by a mating surface of the mounting chassis 18 and on another lateral side by the rear wall of the rear blade 5 (a side of the blade 5 closest to the muzzle).

As shown in FIG. 9, the insert 1 is inserted into the cavity 6 of rear blade 5 such that the insert 1 occupies the cavity 6. The body 1*a* of insert 1 has its side 1*d* aligned with base 11 of rear blade 5. The opening 4 of the insert 1 is positioned so as to face away from the front side of the blade 5 shown in FIG. 8 and instead to face against a mating surface of the mounting chassis discussed below. The shoulders 1*b* are contoured so as to fit within corresponding contours of blade 5.

Figure 12:
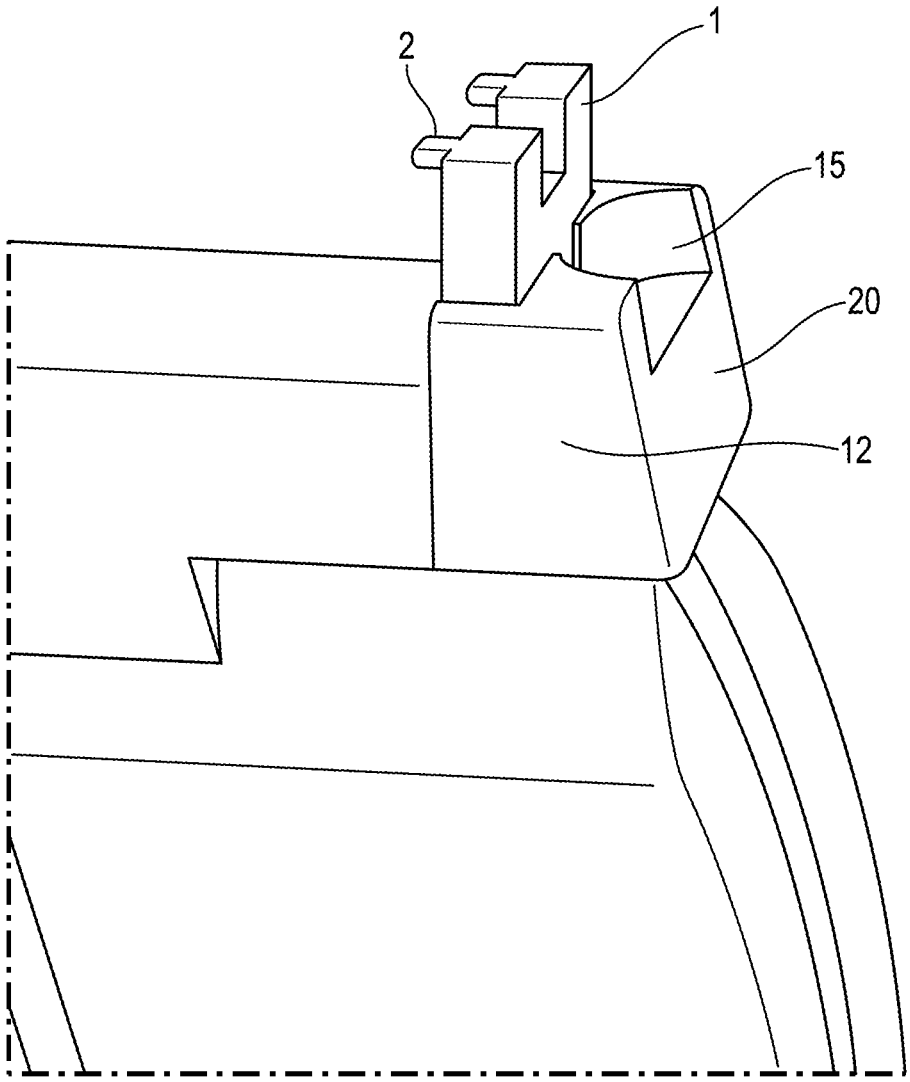
FIG. 12 is a side view of a rear sight notch insert and a rear sight blade according to an exemplary embodiment.

Further, the tabs 2 of the insert project away from the front side of the blade 5. The tabs 2 are positioned at an upper surface of the insert 1. When a user seeks to remove the insert 1 from the cavity 6, the user may simply place the user's fingertips or fingernails beneath the tabs 2 and apply pressure upward. That is, by exerting a relatively small upward force on the tabs 2, the user may urge the tabs 2 upward so as to cause the insert 1 to be dislodged from the cavity 6. When the user seeks to position the insert 1 into the cavity 6, the user applies downward force on the tabs 2 with the user's fingertips or fingernails. FIG. 12 is a side view of insert 1 being removed from cavity 6 by placing a user's fingertips or fingernails under the tabs 2 and lifting. In this manner, no tool is needed to accomplish insertion and/or removal of the insert 1 from the rear blade 5. Further, the insertion and/or removal may be accomplished in mere seconds.

Figure 10:
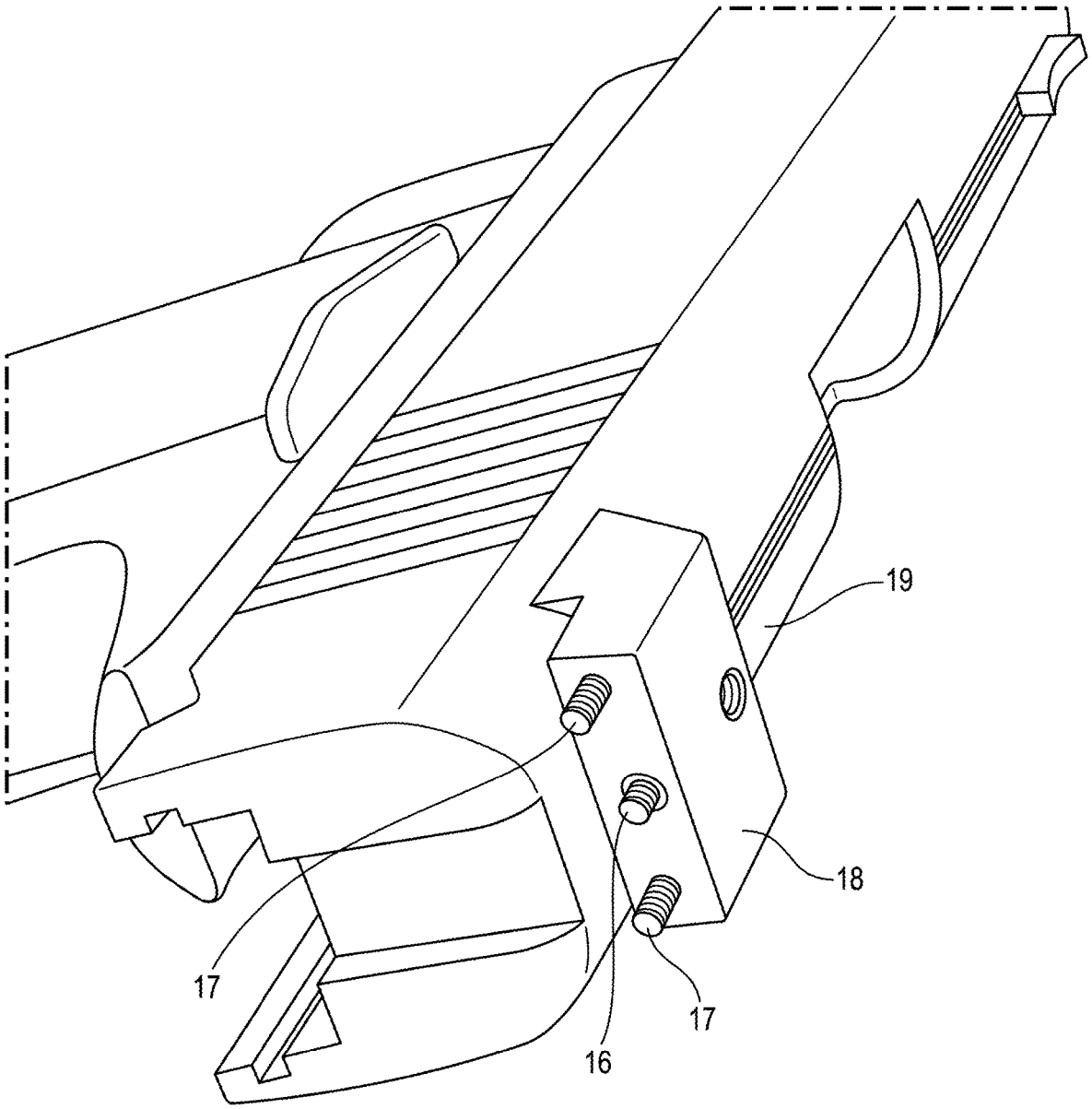
FIG. 10 is a perspective view of a firearm including a slide to which a mounting chassis is attached, according to an exemplary embodiment.
Figure 11:
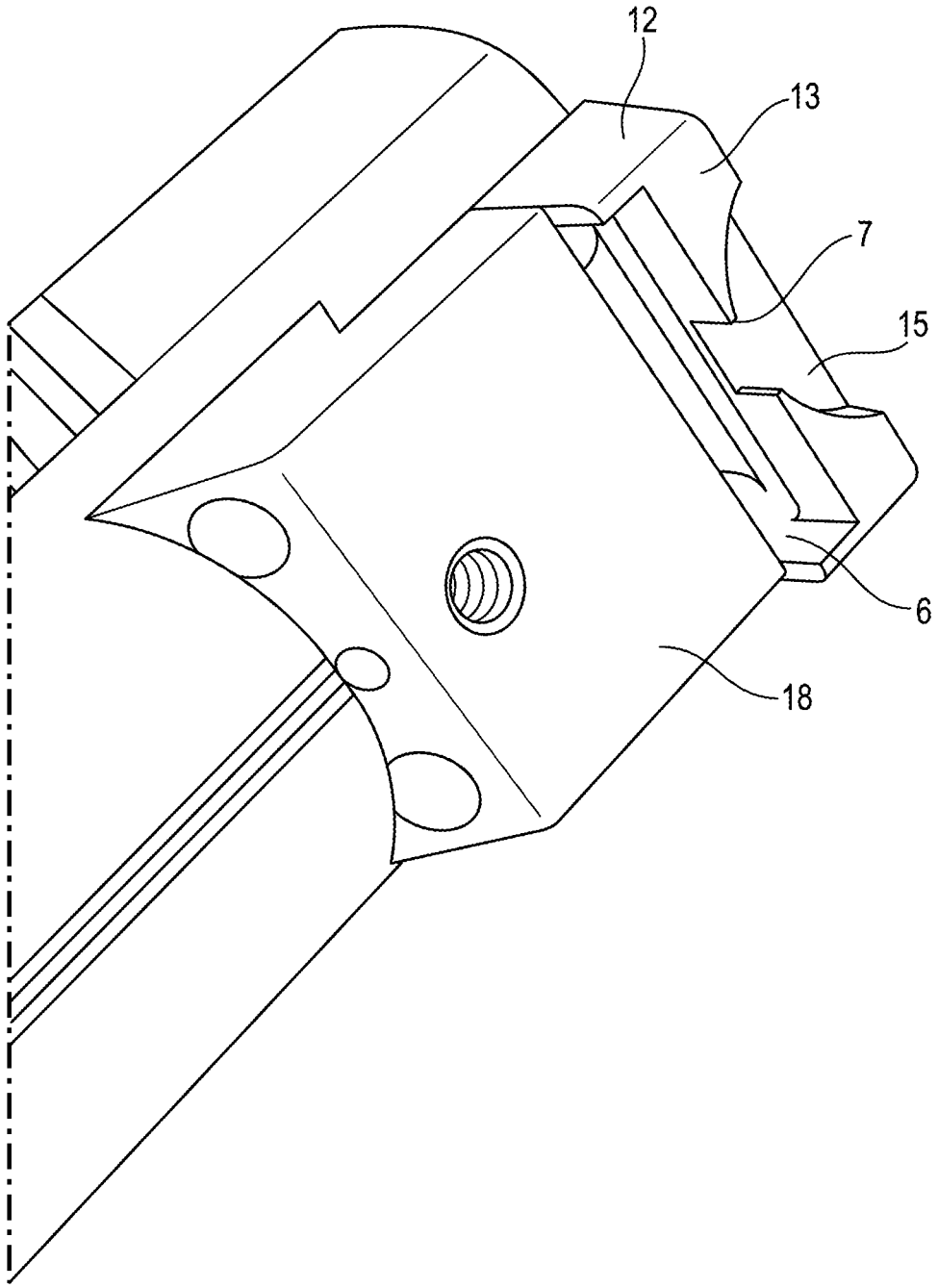
FIG. 11 is a perspective view of a rear sight blade attached to a mounting chassis, according to an exemplary embodiment.

FIG. 10 is a perspective view of a firearm including a slide to which a mounting chassis is attached, according to an exemplary embodiment. More particularly, mounting chassis 18 (also referred to as a mounting base or mounting surface) is depicted as a substantially rectangular base attached to slide 19 of a firearm. The mounting chassis 18 is attached to an upper surface of the slide 19. For example, the mounting chassis 18 may be attached by making a dovetail joint, although other types of joints or mounting methods may be used according to some embodiments. The mounting chassis 18 has, at a side closes to the shooter and further from the muzzle of the firearm, a plurality of alignment or mating elements.

Specifically, in at least one embodiment, mounting chassis 18 is provided with a pair of fasteners 17 on left and right sides of a spring ball plunger 16. The spring ball plunger 16 is at a center of the mounting chassis 18. The spring ball plunger 16 is positioned to be aligned with the opening 4 of insert 1. The spring ball plunger 16 is a spring-loaded ball detent that forms a bearing surface which retracts and then snaps into the opening 4 of insert 1. The spring ball plunger 16 serves a locating and positioning mechanism to retain the insert 1 in place until force is exerted on the tabs 2 to remove the insert 1 from the cavity 6 of the rear blade 5. When such force is applied, the spring in the spring ball plunger 6 compresses and allows the insert 1 to be installed or removed manually.

Figure 13:
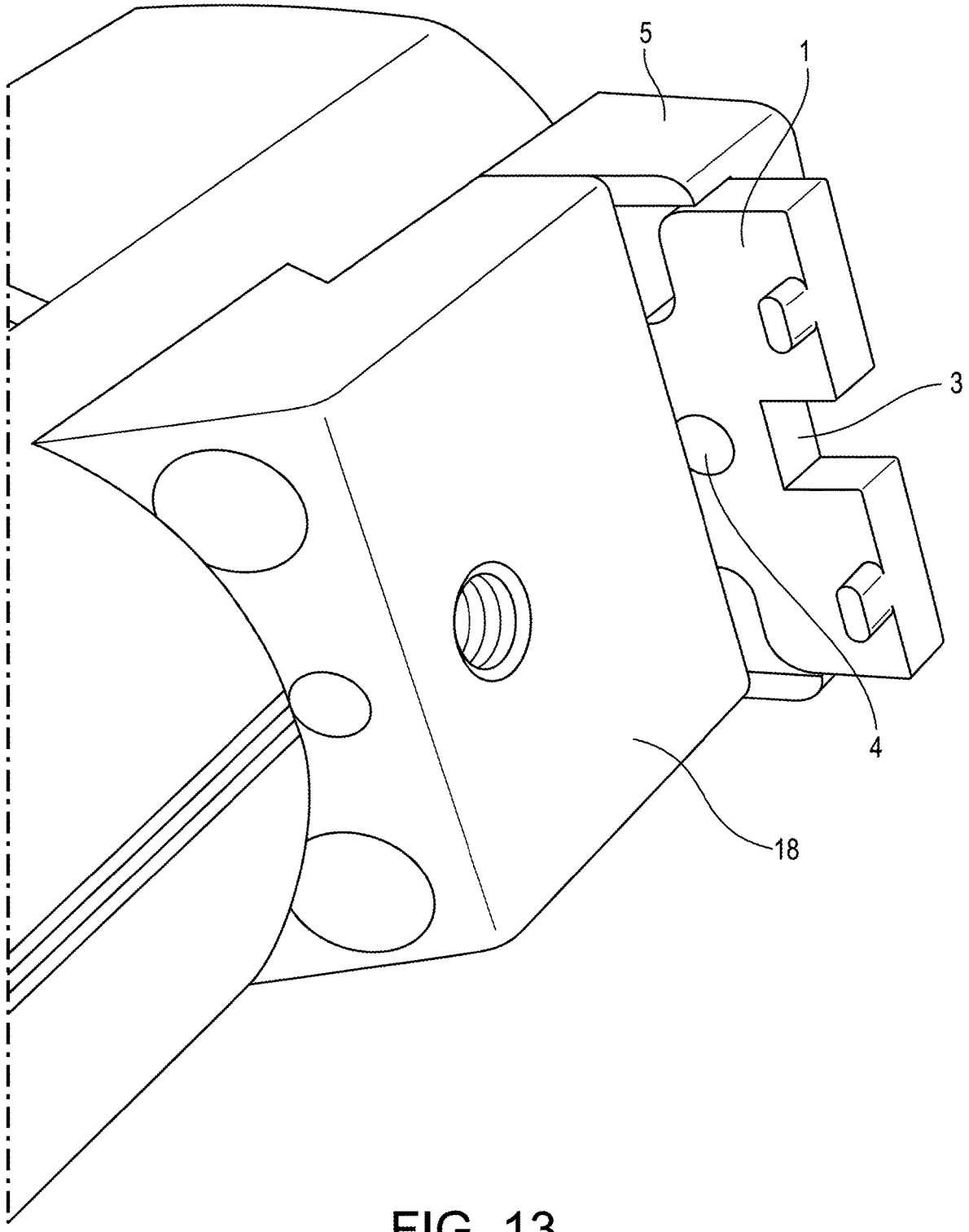
FIG. 13 is a perspective view of an assembly of a rear sight notch insert, a rear sight blade and a mounting structure, according to an exemplary embodiment.

FIG. 13 is a perspective view of an assembly of a rear sight notch insert 1, a rear sight blade 5 and a mounting chassis 18 according to an exemplary embodiment. By employing the tabs 2 and mounting methods described above, insertion and removal of the insert 1 may be accomplished easily, with minimal force and no tools, and quickly. In particular, no screw or screw locking device, or independent springs are needed. In some embodiments, the fasteners 17 are screws on either side of the spring ball plunger 16 that engage with the openings 10 of the rear blade 5 to attach (couple) the rear blade 5 to the mounting chassis 18. Accordingly, the rear blade 5 is thus securely attached to the mounting chassis 18. The spring ball plunger 16 engages the opening 4 of the insert 1, and, together with the accommodation of the insert 1 in cavity 6, acts to ensure that the insert 1 is securely retained and properly positioned.

Although various embodiments have been described, many modifications are possible that do not depart from the scope of the present disclosure. For example, in some embodiments, the insert 1 does not contain any additional elements beyond those shown in FIGS. 1-6. In other alternative embodiments, the insert 1 may be provided with one or more additional components. For example, the insert 1 may be provided with an illuminated sighting element, such as a tritium lamp.

Further, some embodiments relate to methods of utilizing a rear sight on a top surface of a firearm and methods of installing a rear sight notch insert. In at least one embodiment, a method includes installing a rear sight blade 5 on a mounting chassis 18. The rear sight blade 5 includes a cavity 6 machined therein, the cavity being defined between the rear sight blade 5 and the mounting chassis 18. The method further includes inserting a changeable, removable rear sight notch insert 1 into the cavity 6. Additionally, in at least one embodiment, a method of utilizing a rear sight on a top surface of a firearm includes inserting a changeable, removable rear sight notch insert 1 into the cavity 6, which is configured to accept the same, and which cavity 6 is present in a rear sight blade 5 that is installed on the mounting chassis 18.

As utilized herein, the terms "approximately," "about," "substantially", and similar terms are intended to have a broad meaning in harmony with the common and accepted usage by those of ordinary skill in the art to which the subject matter of this disclosure pertains. It should be understood by those of skill in the art who review this disclosure that these terms are intended to allow a description of certain features described and claimed without restricting the scope of these features to the precise numerical ranges provided. Accordingly, these terms should be interpreted as indicating that insubstantial or inconsequential modifications or alterations of the subject matter described and claimed are considered to be within the scope of the invention as recited in the appended claims.

It should be noted that the term "exemplary" as used herein to describe various embodiments is intended to indicate that such embodiments are possible examples, representations, and/or illustrations of possible embodiments (and such term is not intended to connote that such embodiments are necessarily extraordinary or superlative examples).

The terms "coupled," "connected," and the like as used herein mean the joining of two members directly or indirectly to one another. Such joining may be stationary (e.g., permanent) or moveable (e.g., movable, removable, or releasable). Such joining may be achieved with the two members or the two members and any additional intermediate members being integrally formed as a single unitary body with one another or with the two members or the two members and any additional intermediate members being attached to one another.

References herein to the positions of elements (e.g., "top," "bottom," "above," "below," etc.) are merely used to describe the orientation of various elements in the FIGURES. It should be noted that the orientation of various elements may differ according to other exemplary embodiments, and that such variations are intended to be encompassed by the present disclosure.

It is important to note that the construction and arrangement of the rear sight as shown in the various exemplary embodiments are illustrative only. As mentioned above, although only a few embodiments have been described in detail in this disclosure, those skilled in the art who review this disclosure will readily appreciate that many modifications are possible (e.g., variations in sizes, dimensions, structures, shapes and proportions of the various elements, values of parameters, mounting arrangements, use of materials, colors, orientations, etc.) without materially departing from the novel teachings and advantages of the subject matter described herein. For example, elements shown as integrally formed may be constructed of multiple parts or elements, the position of elements may be reversed or otherwise varied, and the nature or number of discrete elements or positions may be altered or varied. The order or sequence of any process or method of steps may be varied or re-sequenced according to alternative embodiments. Other substitutions, modifications, changes and omissions may also be made in the design, operating conditions and arrangement of the various exemplary embodiments without departing from the scope of the present invention.

What is claimed is:

1. A rear sight comprising:

a changeable, removable rear sight notch insert; and a rear sight blade including a cavity configured to receive the changeable, removable rear sight notch insert, the changeable, removable rear sight notch insert comprising a pair of opposed tabs to facilitate manual insertion or removal of the rear sight notch insert into or out of the cavity; and a notch configured to be aligned with a front sight of a firearm, wherein the tabs comprise a first tab and a second tab;

the first tab and the second tab are provided on a same side of the rear sight notch insert with the notch positioned between the first tab and the second tab; and the first tab and the second tab project laterally in a direction perpendicular to a direction in which the rear sight notch insert is inserted into the cavity.

2. The rear sight of claim 1, wherein:

the rear sight blade is configured to accommodate a plurality of rear sight notch inserts that vary in one or more of a notch width, a notch depth, or a notch shape.

3. The rear sight of claim 2, wherein the rear sight notch insert includes a rectangular notch.

4. The rear sight of claim 2, wherein the rear sight notch insert includes a U-shaped notch.

5. The rear sight of claim 2, wherein the rear sight notch insert includes a peep notch.

6. The rear sight of claim 2, wherein the rear sight notch insert includes a square notch.

7. The rear sight of claim 2, wherein the notch is configured to align with the front sight such that the rear sight blade is usable as the rear sight even when the rear sight notch insert is not positioned in the cavity.

8. The rear sight of claim 1, wherein the tabs are configured to be pulled so as to remove the rear sight notch insert from the cavity.

9. The rear sight of claim 8, wherein the tabs are configured to be engaged so as to insert or remove the entirety of the rear sight notch insert from the cavity without a tool.

10. The rear sight of claim 8, wherein the tabs are configured to be pulled upward when a user's fingertip or fingernail is positioned so as to exert force on the tabs from underneath the tabs.

11. A rear sight for use on a firearm, the rear sight comprising:

a changeable, removable rear sight blade configured to couple to a mounting base; and an insert comprising a pair of opposed tabs to facilitate manual insertion or removal of the insert;

wherein the changeable, removable rear sight blade is configured to allow a rear sighting notch of the insert to be aligned with a post on a front sight;

wherein a configuration of the rear sighting notch is variable, wherein insert includes a notch configured to be aligned with the front sight, and wherein the tabs comprise a plurality of tabs that are coincident with an upper edge of the insert, the tabs positioned on a side of the insert that faces one of a muzzle end or a shooter end of the firearm when inserted into the rear sight blade.

12. The rear sight of claim 11, wherein the insert is structured as a notched member with the notch being in a center of the insert.

13. The rear sight of claim 12, wherein the entirety of the notched member is configured to be inserted and removed without a tool.

14. The rear sight of claim 12, wherein the notched member is configured to be installed in a cut machined into the rear sight blade.

15. The rear sight of claim 14, wherein the tabs are configured for installation into and removal from the cut.

16. The rear sight of claim 15, wherein the rear sight notch insert is positioned to be visible to the user.

17. The rear sight of claim 16, wherein the rear sight notch insert or portion thereof is positioned so as to be contained between the rear sight blade and the mounting base.

18. The rear sight of claim 17, wherein the mounting base is configured to be connected to a top surface of the firearm.

19. The rear sight of claim 15, wherein the rear sight notch insert includes a hole positioned beneath the sighting notch.

20. The rear sight of claim 19, wherein the hole has a hemispherical or cupped shape.

21. The rear sight of claim 15, wherein the rear sight notch insert includes a rectangular notch.

22. The rear sight of claim 15, wherein the rear sight notch insert includes a U-shaped notch.

23. The rear sight of claim 15, wherein the rear sight notch insert includes a peep notch.

24. The rear sight of claim 15, wherein the rear sight notch insert includes a square notch.

25. A method of utilizing a rear sight on a top surface of a firearm, comprising:

inserting a changeable, removable rear sight notch insert into a cavity configured to accept the same, the cavity being present in a rear sight blade that is installed on a mounting chassis, wherein the rear sight notch insert is provided with a notch configured to be aligned with a front sight of the firearm; and a pair of opposed tabs comprising a first tab and a second tab, the first tab and the second tab being provided on a same side of the rear sight notch insert with the notch positioned between the first tab and the second tab;

wherein the first tab and the second tab project laterally in a direction perpendicular to a direction in which the rear sight notch insert is inserted into the cavity; and wherein inserting the rear sight notch insert comprises manually exerting force on the tabs.

26. The method of claim 25, wherein inserting the removable rear sight notch insert comprises positioning the removable rear sight notch insert into the cavity by pressing down on the tabs, which are provided at a top of the removable rear sight notch insert.

27. The method of claim 25, further comprising selecting the changeable, removable rear sight notch insert from among a plurality of rear sight notch inserts varying in one or more of a notch width, a notch depth, or a notch shape.

28. The method of claim 27, wherein insertion and removal of the entirety of the rear sight notch insert is performed manually.

29. The method of claim 25, further comprising removing the rear sight notch insert from the cavity by exerting force on the pair of tabs, which are provided at a top surface of the rear sight notch insert.

30. The method of claim 25, further comprising aligning the notch of the rear sight notch insert with the front sight of the firearm, which is a handgun.

* * * * *